US012246812B2

(12) United States Patent
Kraus et al.

(10) Patent No.: US 12,246,812 B2
(45) Date of Patent: Mar. 11, 2025

(54) STOWABLE MARINE PROPULSION SYSTEMS

(71) Applicant: Brunswick Corporation, Mettawa, IL (US)

(72) Inventors: Jeremy J. Kraus, Mt. Calvary, WI (US); Aaron J. Novak, North Fond du Lac, WI (US); Brandon C. Andrus, Oakfield, WI (US); Kenneth E. Peterson, Waupun, WI (US); Joshua S. Smith, Mayville, WI (US)

(73) Assignee: Brunswick Corporation, Mettawa, IL (US)

( * ) Notice: Subject to any disclaimer, the term of this patent is extended or adjusted under 35 U.S.C. 154(b) by 113 days.

(21) Appl. No.: 18/091,062

(22) Filed: Dec. 29, 2022

(65) Prior Publication Data

US 2023/0132886 A1 May 4, 2023

Related U.S. Application Data

(63) Continuation of application No. 17/185,289, filed on Feb. 25, 2021, now Pat. No. 11,572,146.

(51) Int. Cl.
*B63H 5/125* (2006.01)
*B63B 1/12* (2006.01)
(Continued)

(52) U.S. Cl.
CPC ..... *B63H 21/21* (2013.01); *B63B 1/125* (2013.01); *B63B 35/38* (2013.01); *B63B 79/10* (2020.01);
(Continued)

(58) Field of Classification Search
CPC ..... B63H 5/125; B63H 20/02; B63H 2005/1256; B63H 2025/425; B63H 25/42;
(Continued)

(56) References Cited

U.S. PATENT DOCUMENTS 2,213,520 A 9/1940 Gentry
3,236,202 A 2/1966 Quady et al.
(Continued)

FOREIGN PATENT DOCUMENTS

EP 1611007 8/2007
EP 1914161 4/2008
(Continued)

OTHER PUBLICATIONS

Tornbaum, Andres Perdomo, "Methods for a Marine Vessel with Primary and Auxiliary Propulsion Devices," Unpublished U.S. Appl. No. 16/984,617, filed Aug. 4, 2020 (specification and drawings only).

(Continued)

*Primary Examiner* — Andrew Polay
(74) *Attorney, Agent, or Firm* — Andrus Intellectual Property Law, LLP

(57) ABSTRACT

A stowable propulsion system for a marine vessel. A base is configured to be coupled to the marine vessel. A propulsion device is configured to propel the marine vessel in water. A shaft extends along a length axis and pivotably couples the propulsion device to the base. The propulsion device is pivotable into and between a stowed position and a deployed position, wherein pivoting the propulsion device causes the shaft to rotate about the length axis.

20 Claims, 12 Drawing Sheets

(51) Int. Cl.

| | |
|---|---|
| ***B63B 35/38*** | (2006.01) |
| ***B63B 79/10*** | (2020.01) |
| ***B63H 1/14*** | (2006.01) |
| ***B63H 20/10*** | (2006.01) |
| ***B63H 21/12*** | (2006.01) |
| ***B63H 21/21*** | (2006.01) |
| ***B63H 23/04*** | (2006.01) |
| ***B63H 25/42*** | (2006.01) |
| *B63H 20/00* | (2006.01) |

(52) U.S. Cl.
CPC ..... *B63H 1/14* (2013.01); *B63H 20/10* (2013.01); *B63H 21/12* (2013.01); *B63H 23/04* (2013.01); *B63H 2005/1258* (2013.01); *B63H 20/007* (2013.01); *B63H 2025/425* (2013.01)

(58) Field of Classification Search
CPC ..... B63H 21/21; B63H 1/14; B63H 21/12; B63H 23/04; B63B 1/125; B63B 35/38; B63B 79/10
See application file for complete search history.

(56) References Cited

U.S. PATENT DOCUMENTS

| | | | | |
|---|---|---|---|---|
| 3,462,102 | A | 8/1969 | Rivers | |
| 3,809,343 | A | 5/1974 | Adams et al. | |
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,548,586 | A | 10/1985 | Philips | |
| 4,734,068 | A | 3/1988 | Edwards | |
| 4,875,656 | A | 10/1989 | Boede | |
| 4,911,398 | A | 3/1990 | Diiulio et al. | |
| 4,966,566 | A | 10/1990 | Baird | |
| 5,005,798 | A | 4/1991 | McCoy | |
| 5,022,609 | A | 6/1991 | Cranston | |
| 5,131,875 | A | 7/1992 | Lee | |
| 5,152,240 | A | 10/1992 | Fontanille | |
| 5,195,914 | A | 3/1993 | Binversie et al. | |
| 5,277,630 | A * | 1/1994 | Clark | B63H 20/007 248/642 |
| 5,499,792 | A | 3/1996 | Tamiso | |
| 5,595,133 | A | 1/1997 | Bullard | |
| 5,639,272 | A | 6/1997 | Henderson et al. | |
| 5,669,794 | A | 9/1997 | Knight et al. | |
| 5,941,742 | A | 8/1999 | Whitaker | |
| 6,142,841 | A | 11/2000 | Alexander, Jr. et al. | |
| 6,257,165 | B1 | 7/2001 | Danos et al. | |
| 6,280,267 | B1 | 8/2001 | Griffith, Sr. et al. | |
| 6,325,685 | B1 | 12/2001 | Knight et al. | |
| 6,431,923 | B1 | 8/2002 | Knight et al. | |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 | 12/2006 | Janitz | |
| 7,182,033 | B1 | 2/2007 | Philips et al. | |
| 7,185,599 | B1 | 3/2007 | Griffiths et al. | |
| 7,285,029 | B1 | 10/2007 | Janitz | |
| 7,294,029 | B1 | 11/2007 | Spaulding | |
| 7,305,928 | B2 | 12/2007 | Bradley et al. | |
| 7,399,211 | B1 | 7/2008 | Spaulding | |
| 7,510,450 | B1 | 3/2009 | Dresher | |
| 7,520,239 | B2 | 4/2009 | Bryham | |
| 7,533,622 | B1 | 5/2009 | Jaszewski et al. | |
| 7,753,745 | B2 | 7/2010 | Schey et al. | |
| 7,806,065 | B1 | 10/2010 | Bekker et al. | |
| 7,887,381 | B2 | 2/2011 | Brass et al. | |
| 7,946,243 | B1 | 5/2011 | Ulrich | |
| 8,011,982 | B1 | 9/2011 | Baier et al. | |
| 8,051,793 | B2 | 11/2011 | Ulgen | |
| 8,123,577 | B2 | 2/2012 | Riggs | |
| 8,479,677 | B2 | 7/2013 | Bolline et al. | |
| 8,814,616 | B2 | 8/2014 | Riggs | |
| 9,108,710 | B1 | 8/2015 | McChesney et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 | 2/2018 | Ostrowsky | |
| 9,896,162 | B2 | 2/2018 | McClure | |
| 9,969,474 | B1 | 5/2018 | Traux et al. | |
| 10,167,069 | B2 | 1/2019 | Houle et al. | |
| 10,220,926 | B1 | 3/2019 | Pelini | |
| 10,407,131 | B1 | 9/2019 | Ward | |
| 10,850,820 | B1 | 12/2020 | Minogue | |
| 11,591,057 | B2 | 2/2023 | Tornbaum et al. | |
| 11,603,179 | B2 | 3/2023 | Poirier et al. | |
| 11,643,176 | B1 | 5/2023 | Mueller et al. | |
| 2002/0142680 | A1 | 10/2002 | Anderson | |
| 2006/0228959 | A1 | 10/2006 | Ruiz | |
| 2007/0232159 | A1 | 10/2007 | Lee | |
| 2008/0190227 | A1 | 8/2008 | Myers et al. | |
| 2009/0227158 | A1 | 9/2009 | Bernloehr et al. | |
| 2010/0032545 | A1 | 2/2010 | Bernloehr et al. | |
| 2010/0116967 | A1 | 5/2010 | Todd et al. | |
| 2010/0136857 | A1 | 6/2010 | Goudsmit | |
| 2012/0097086 | A1 | 4/2012 | Sancoff | |
| 2014/0158037 | A1 | 6/2014 | George | |
| 2015/0201548 | A1 | 7/2015 | Wolter et al. | |
| 2015/0259033 | A1 | 9/2015 | George et al. | |
| 2016/0001865 | A1 | 1/2016 | Bernloehr et al. | |
| 2017/0203823 | A1 | 7/2017 | Abney | |
| 2017/0341718 | A1 | 11/2017 | Zimmerman | |
| 2018/0334233 | A1 | 11/2018 | Vance | |
| 2019/0217921 | A1 | 7/2019 | Shibayama et al. | |
| 2021/0354803 | A1 | 11/2021 | Christensen et al. | |
| 2021/0380210 | A1 | 12/2021 | Fishburn et al. | |
| 2022/0266968 | A1 | 8/2022 | Tornbaum et al. | |

FOREIGN PATENT DOCUMENTS

| | | |
|---|---|---|
| EP | 2757037 | 7/2014 |
| EP | 2242678 | 11/2015 |
| EP | 2246252 | 5/2019 |
| GB | 2554045 | 3/2018 |
| JP | 2013100013 | 5/2013 |

OTHER PUBLICATIONS

Owerboat Television, "How to make docking a pontoon boat easy with a retractable SideShift Thruster | My Boat DIY", YouTube video, Jun. 1, 2020, available at https://www.youtube.com/watch?v=2NBx-Vnl3Kk.

Sideshift Inc., "Sideshift Dock Like a Pro PT230/PT360 Pontoon Thruster System," Installation/Operation Manual, Oct. 2019, vol. 2.4.

International Search Report and Written Opinion for International Application No. PCT/CA/2016/050308 mailed Jun. 9, 2016.

Unpublished U.S. Appl. No. 17/377,061, filed Jul. 15, 2021 by Andres Perdomo Tornbaum.

Unpublished U.S. Appl. No. 17/376,869, filed Jul. 15, 2021 by Jeremy J. Kraus.

Unpublished U.S. Appl. No. 17/378,383, filed Jul. 16, 2021 by Andres Perdomo Tornbaum.

Unpublished U.S. Appl. No. 17/379,435, filed Jul. 19, 2021 by Andres Perdomo Tornbaum.

Unpublished U.S. Appl. No. 17/388,850, filed Jul. 29, 2021 by Jeremy J. Kraus.

Unpublished U.S. Appl. No. 17/553,245, filed Dec. 16, 2021 by Jeremy J. Kraus.

Unpublished U.S. Appl. No. 29/823,128, filed Jan. 14, 2022 by Matthew Z. Seta.

(56) References Cited

OTHER PUBLICATIONS

Unpublished U.S. Appl. No. 18/091,062, filed Dec. 29, 2022 by Jeremy J. Kraus.
Unpublished U.S. Appl. No. 18/099,784, filed Jan. 20, 2023 by Jim Erickson.

* cited by examiner

STOWABLE MARINE PROPULSION SYSTEMS

CROSS REFERENCE TO RELATED APPLICATION

This application is a continuation of U.S. patent application Ser. No. 17/185,289, filed Feb. 25, 2021, which is incorporated herein by reference in its entirety.

FIELD

The present disclosure generally relates to stowable propulsion systems for marine vessels.

BACKGROUND

The following U.S. Patents and Patent Applications provide background information and are incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired. Electrical embodiments can utilize one or more pairs of impellers to cause fluid to flow through outlet conduits to provide thrust on the marine vessel.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion system. An example indicator includes a light operatively coupled to a propulsion system of a watercraft, wherein an operation of the light indicates a status of a thruster system of the propulsion system.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP20133100013A also provide background information and are incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a stowable propulsion system for a marine vessel. In certain embodiments, a base is configured to be coupled to the marine vessel. A shaft has a proximal end and a distal end with a length axis defined therebetween, where the shaft is pivotably coupled to the base and pivotable about a transverse axis between a stowed position and a deployed position, and where the distal end is closer to the marine vessel when in the stowed position than in the deployed position. A gearset is engaged between the shaft and the base, where the gearset rotates the shaft about the length axis when the shaft is pivoted between the stowed position and the deployed position. A propulsion device is coupled to the distal end of the shaft. The propulsion device is configured to propel the marine vessel in water when the shaft is in the deployed position.

In certain embodiments, a marine vessel is configured to be propelled in a port-starboard direction. The marine vessel includes two or more pontoons coupled to a deck, where the two or more pontoons provide floatation for the marine vessel. A stowable propulsion system is configured to propel the marine vessel in the port-starboard direction. The system includes a base coupled to the marine vessel between two or the two or more pontoons. The system further includes a shaft having a proximal end and a distal end with a length axis defined therebetween, where the shaft is pivotably coupled to the base and pivotable about a transverse axis between a stowed position and a deployed position, and where the distal end is closer to the marine vessel when in the stowed position than in the deployed position. The system further includes a gearset engaged between the shaft and the base, where the gearset rotates the shaft about the length axis when the shaft is pivoted between the stowed position and the deployed position. The system further includes a propulsion device coupled to the distal end of the shaft. The propulsion device is configured to propel the marine vessel in water in the port-starboard direction when the shaft is in the deployed position.

Some embodiments include a stowable propulsion system for a marine vessel having two or more pontoons coupled to a deck. The system includes a base configured to be coupled to deck of the marine vessel between two of the two or more pontoons, where the two or more pontoons extend in a fore-aft direction. A shaft has a proximal end and a distal end with a length axis defined therebetween, where the shaft is pivotably coupled to the base, the shaft being pivotable about a transverse axis between a stowed position and a deployed position, and where the distal end is closer to the marine vessel when in the stowed position than in the deployed position. An electric actuator is coupled to the shaft and to the base, where the electric actuator pivots the shaft between the stowed position and the deployed position. A positional sensor is positioned to detect whether the shaft is in at least one of the stowed position and the deployed position. A gearset is engaged between the shaft and the base, where the gearset rotates the shaft 90 degrees about the length axis when the shaft is pivoted between the stowed position and the deployed position, where the gearset rotates the shaft in a first direction when the shaft is pivoted towards the deployed position and in a second direction that is opposite the first direction when the shaft is pivoted towards the stowed position. A control system is operatively coupled to the actuator and the positional sensor, where the control system is configured to control the actuator to pivot the shaft based on the positional sensor. A propulsion device is coupled to the distal end of the shaft, where the propulsion device comprises an electric motor that rotates a propeller, and where electricity is supplied to electric motor via a wire harness that extends through at least a portion of the shaft. The propulsion device is configured to propel the marine vessel in water in a port-starboard direction that is perpendicular to the fore-aft direction when the shaft is in the deployed position.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present inventors have recognized a problem with bow thrusters presently known in the art, and particularly those that are retractable for storage. Specifically, within the context of a marine vessel having pontoons, there is insufficient clearance between the pontoons to accommodate a propulsive device, and particularly a propulsive device oriented to create propulsion in the port-starboard direction. The problem is further exacerbated when considering how marine vessels are trailered for transportation over the road. One common type of trailer is a scissor type lift in which bunks are positioned between the pontoons to lift the vessel by the underside of the deck. An exemplary lift of this type is the "Scissor Lift Pontoon Trailer" manufactured by Karavan in Fox Lake, Wis. In this manner, positioning a bow thruster between a marine vessel's pontoons either precludes the use of a scissor lift trailer, or leaves so little clearance that damage to the bow thruster and/or trailer is likely to occur during insertion, lifting, and/or transportation of the vessel on the trailer. As such, the present inventors have recognized an unmet need to rotate the propulsion device in a fore-aft orientation when stowed to minimize the width of the bow thruster. Additionally, the present inventors have recognized a particular advantage for developing such a rotatable propulsion device that does not require additional actuators for this rotation, adding cost and complexity to the overall system.

Figure 1:
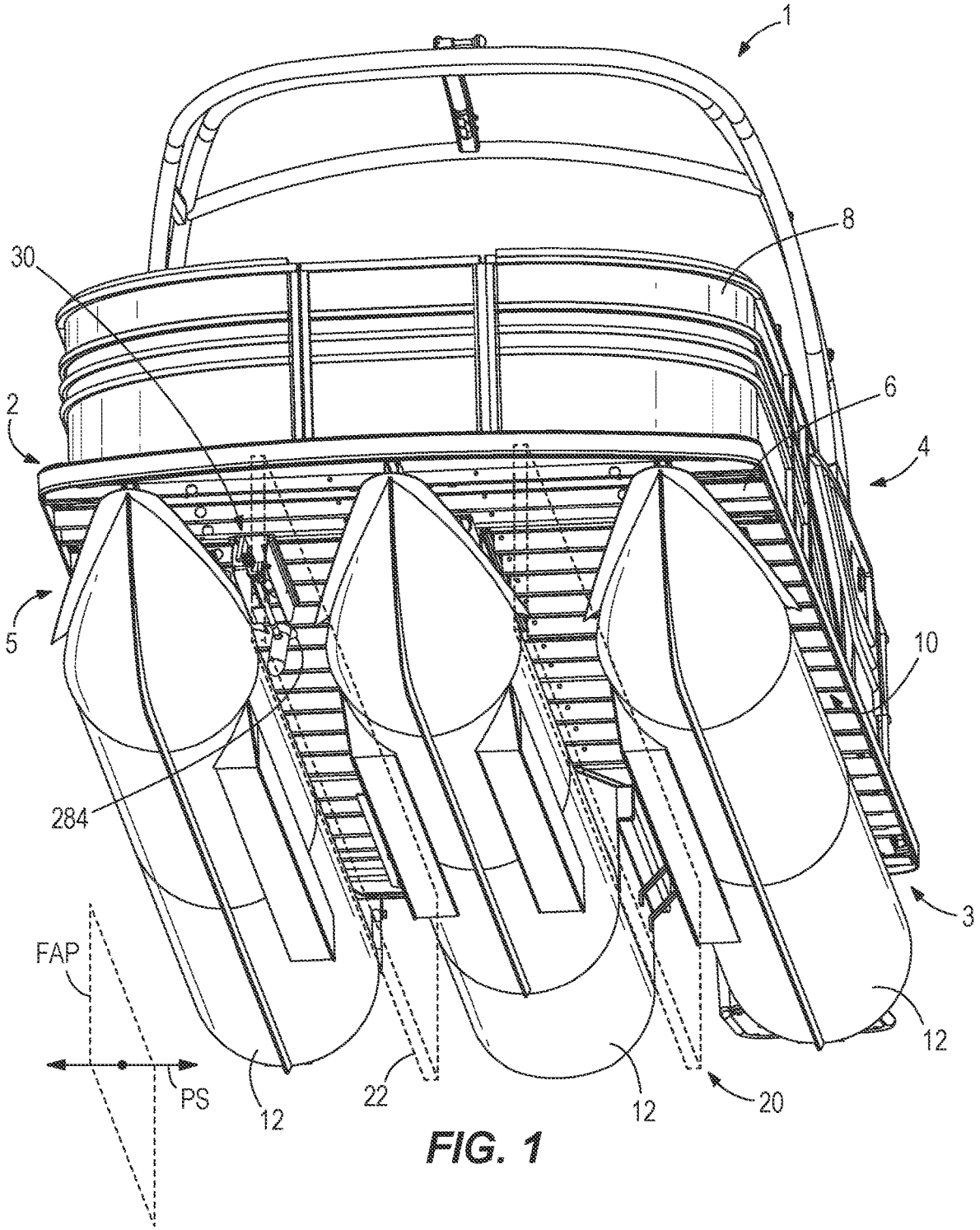
FIG. 1 is an isometric bottom view of a marine vessel incorporating a stowable propulsion system according to the present disclosure.

FIG. 1 depicts the underside of a marine vessel 1 as generally known in the art, but outfitted with an embodiment of a stowable propulsion system 30 according to the present disclosure. The marine vessel 1 extends between a bow 2 and stern 3, as well as port 4 and starboard 5 side, thereby defining a fore-aft plane FAP, and port-starboard direction PS. The marine vessel 1 further includes a deck 6 with a rail system 8 on top and pontoons 12 mounted to the underside 10 of the deck 6. The marine vessel 1 is shown with a portion of a scissor type lift 20, specifically the bunks 22, positioned between pontoons 12 to lift and support the marine vessel 1 for transportation over land in a manner known in the art. As is discussed further below, the presently disclosed stowable propulsion device 30 has a propeller 284 that faces the underside 10 of the deck 6 when stowed, in contrast to during use to propel the marine vessel 1 in the water as a bow thruster. This orientation is distinguishable from propulsion devices known in the art, in which the propeller faces the pontoons. In prior art configurations, there typically is insufficient room between the propulsion device and the pontoons to fit the bunks of the scissor type lift without risking damage to the propulsion device while inserting the bunks, lifting the marine vessel, and/or traveling on the road.

Figure 2:
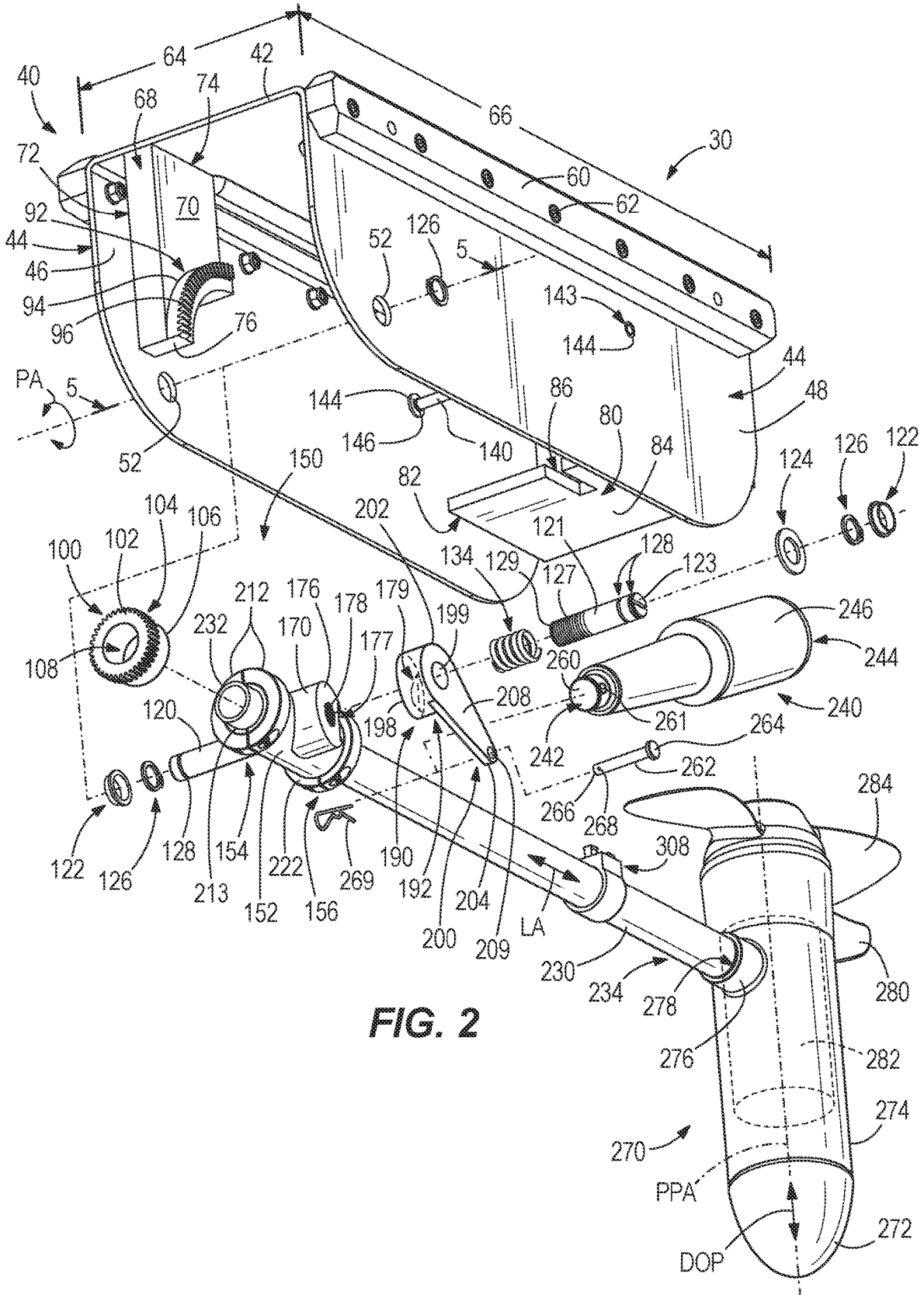
FIG. 2 is an exploded isometric view of a system such as that shown in FIG. 1 in a stowed position.
Figure 3:
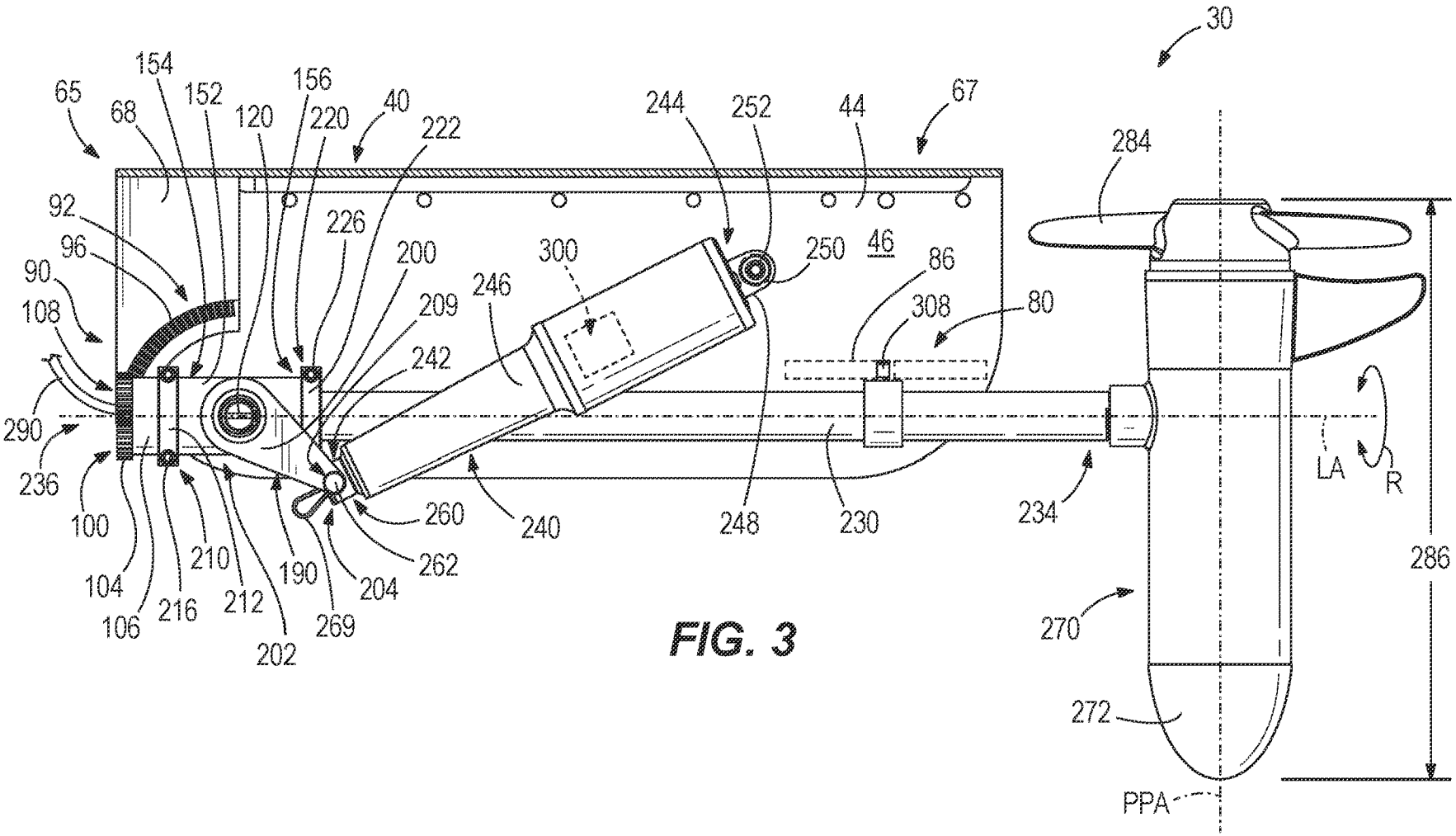
FIG. 3 is a sectional side view taken along the line 3-3 in FIG. 2.
Figure 4:
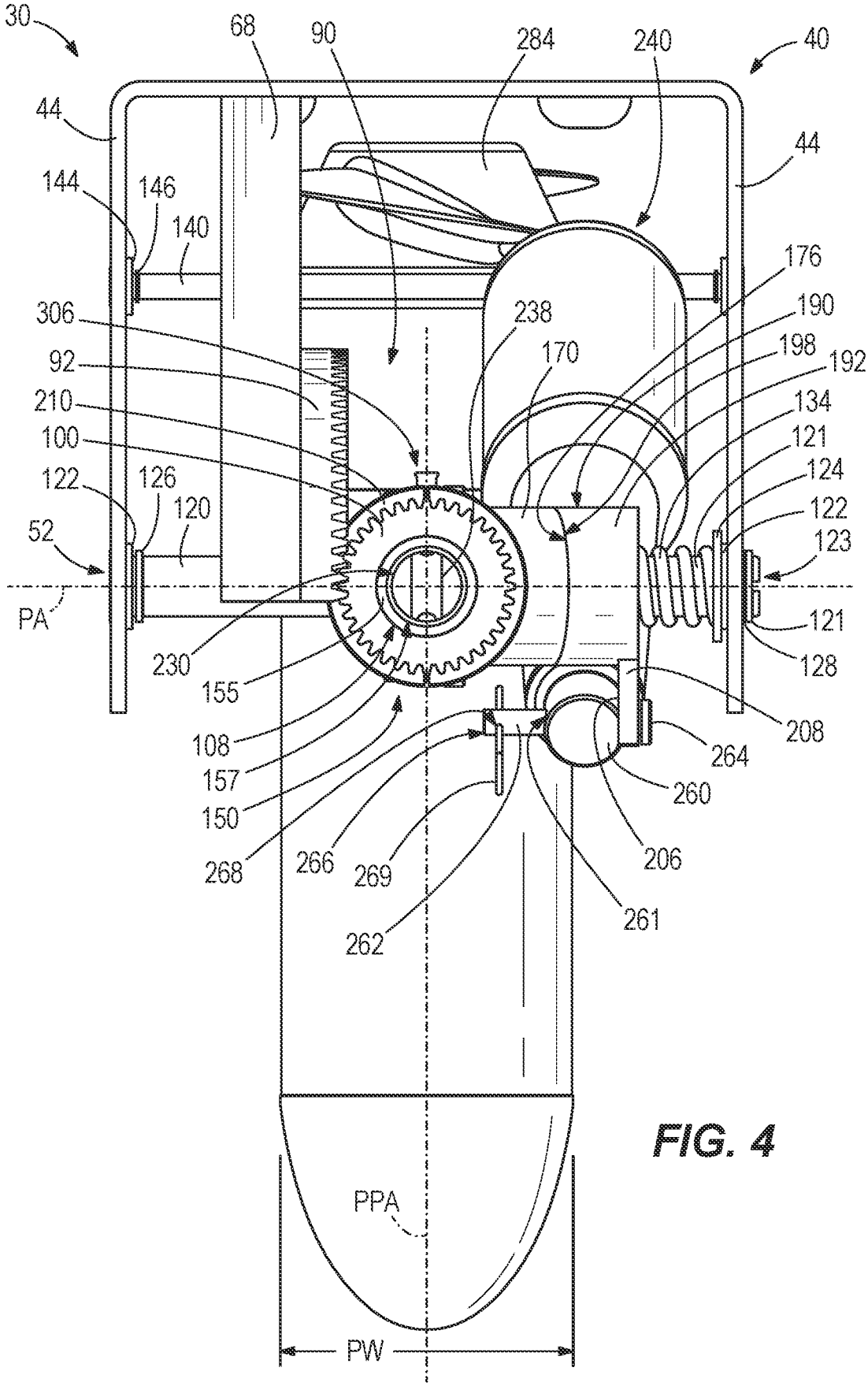
FIG. 4 is a rear view of the system shown in FIG. 2.

FIGS. 2-3 depict an exemplary stowable propulsion system 30 according to the present disclosure, here oriented in a stowed position. The stowable propulsion system 30 includes a base 40 having a top 42 with sides 44 extending perpendicularly downwardly away from the top 42. The sides 44 include an inward side 46 and outward side 48 and extend between a first end 65 and second end 67 defining a length 66 therebetween. A width 64 is defined between the sides 44. A stop 80 having sides 82 and a bottom 84 is coupled between the sides 44 of the base 40. A leg 68 having an inward side 70 and outward side 72 extends between a top end 74 and a bottom end 76. The leg 68 is coupled at the top end 74 to the top 42 of the base 40 and extends perpendicularly downwardly therefrom. A stationary gear 92 having a mesh face 96 with gear teeth and an opposite mounting face 94 is coupled to the leg 68 with the mounting face 94 facing the inward side 70 of the leg 68. As shown in FIG. 4, one or more support rods 140 may also be provided between the sides 44 and received within support rod openings 143 defined therein to provide rigidity to the base 40. In the example shown, the support rod 140 is received within a bushing 144 and held in position by a snap ring 146 received within a groove defined within the support rod 140.

Returning to FIGS. 2-3, the base 40 is configured to be coupled to the marine vessel 1 with the top 42 facing the underside 10 of the deck 6. The base 40 may be coupled to the deck 6 using fasteners and brackets presently known in the art. A mounting bracket 60 is coupled via fasteners 62 (e.g., screws, nuts and bolts, or rivets) to the outward sides 48 of the sides 44 of the base 40. The mounting bracket 60 is receivable in a c-channel bracket or other hardware known in the art (not shown) that is coupled to the deck 6 and/or pontoons 12 to thereby couple the stowable propulsion system 30 thereto.

As shown in FIGS. 2-4, the stowable propulsion system 30 includes a shaft 230 that extends between a proximal end 232 and distal end 234 defining a length axis LA therebetween. The proximal end 232 of the shaft 230 is non-rotatably coupled to a moving gear 100. The moving gear 100 has a proximal face 102 and mesh face 104 having gear teeth, where the mesh face 104 engages with the mesh face 96 of the stationary gear 92 to together form a gearset 90 as discussed further below. The moving gear 100 further includes a barrel 106 that extends perpendicularly relative to the proximal face 102 and is coupled to the shaft 230 in a manner known in the art (e.g., via a set screw or welding). In this manner, the moving gear 100 is fixed to the shaft 230 such that rotation of the moving gear 100 causes rotation of the shaft 230 about the length axis LA.

Figure 5:
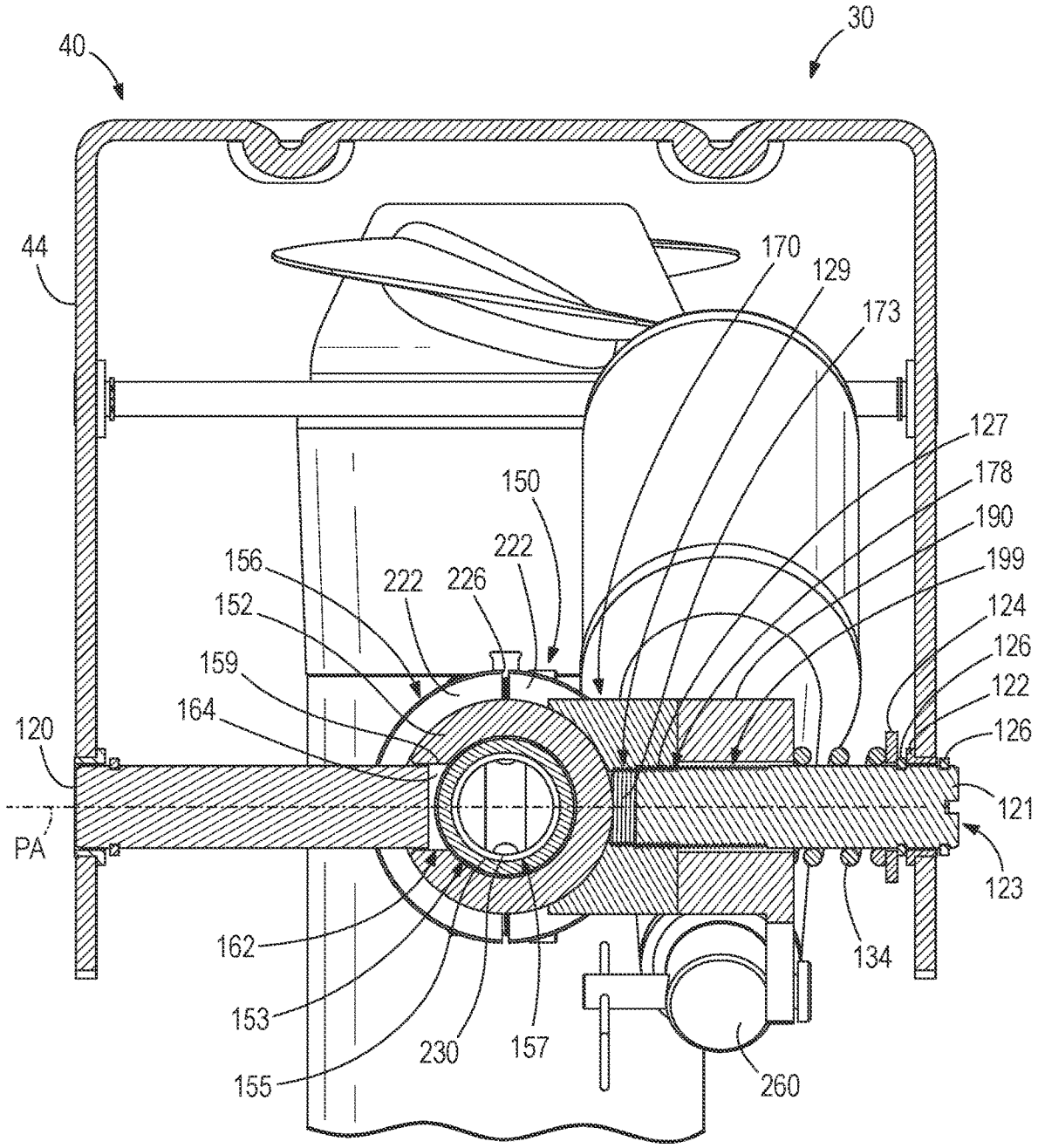
FIG. 5 is a sectional view taken along the line 5-5 of FIG. 2.
Figure 6:
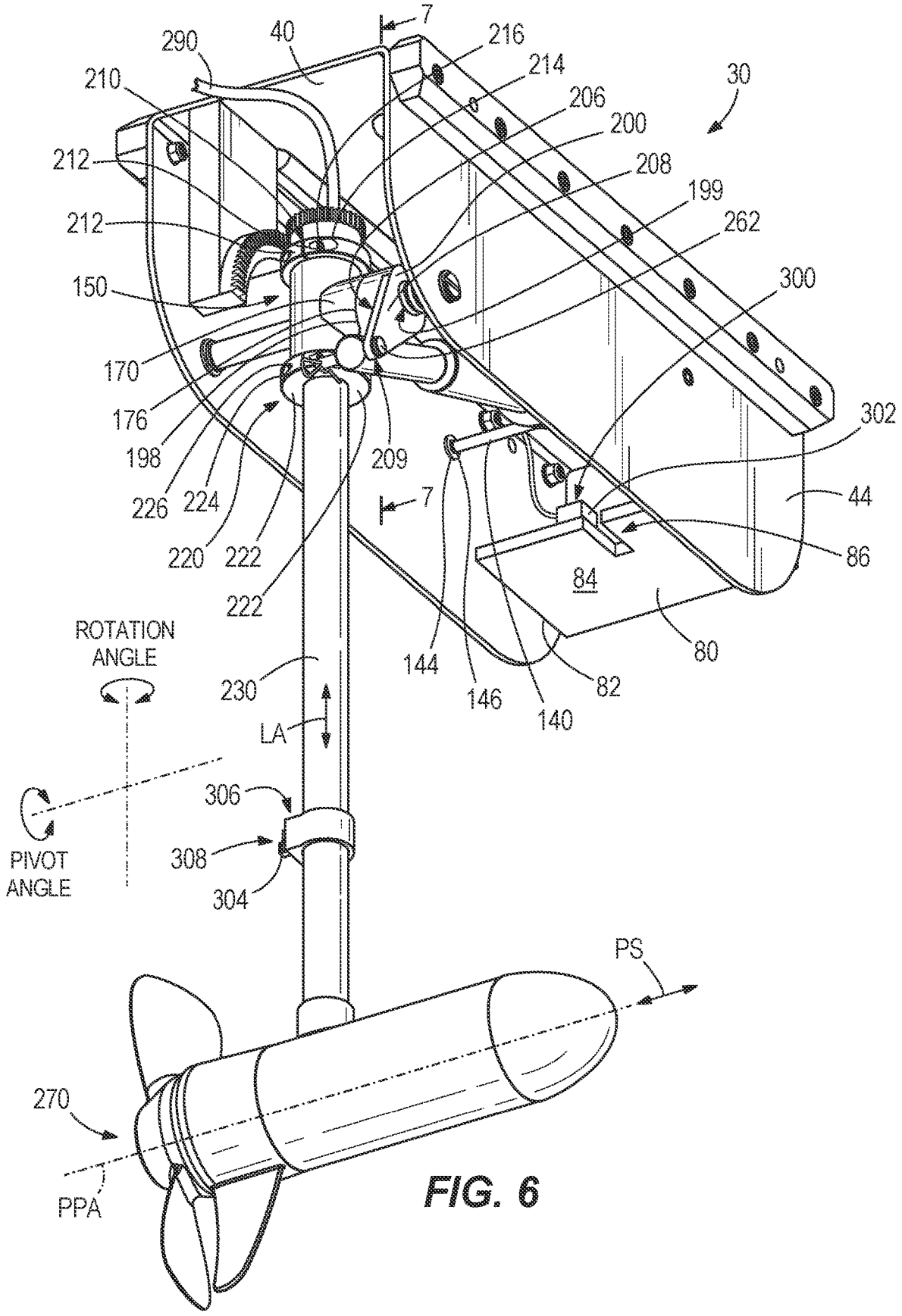
FIG. 6 is an isometric bottom view depicting the system of FIG. 2 in a deployed position.
Figure 7:
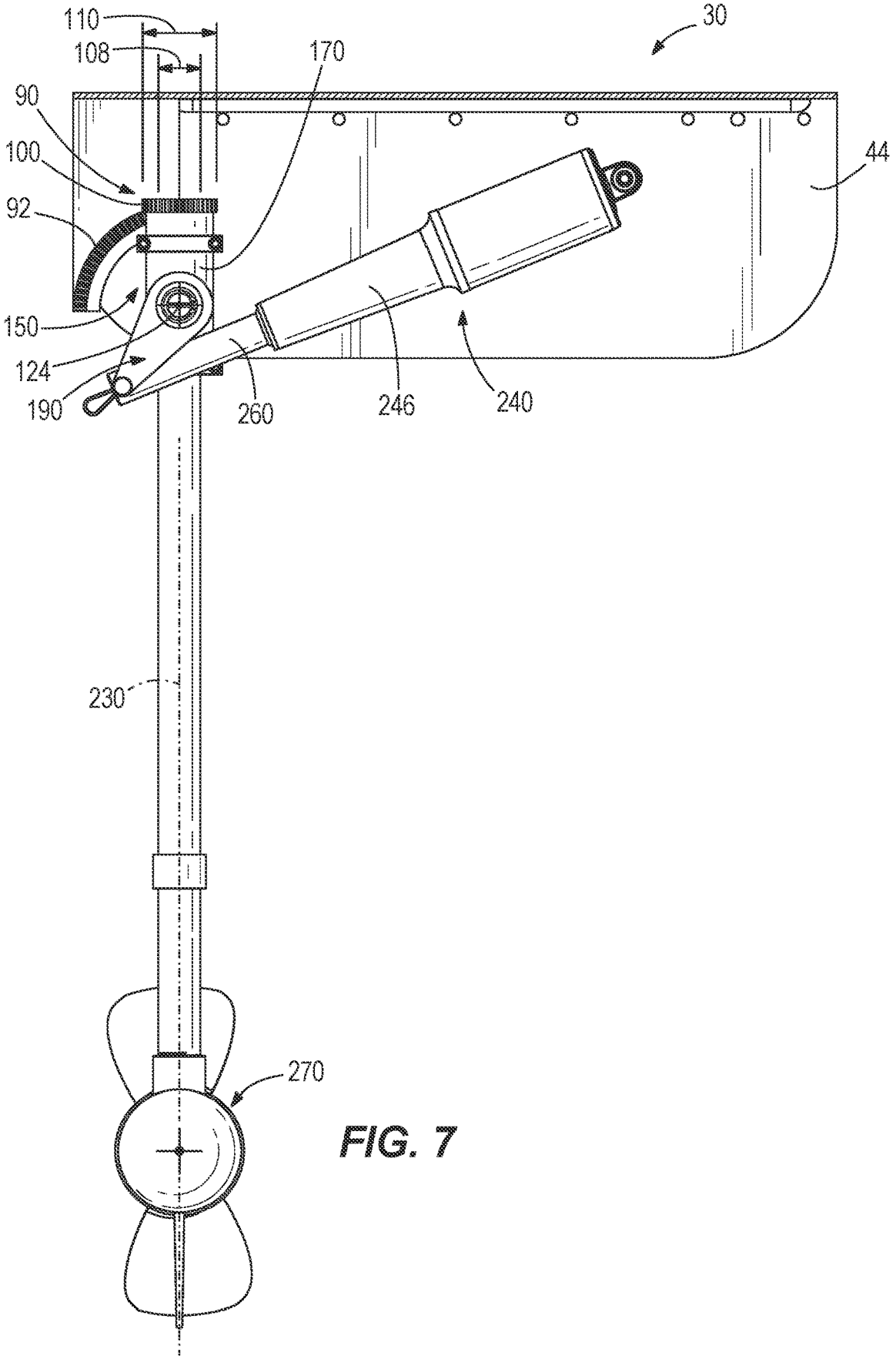
FIG. 7 is a sectional side view taken along the line 7-7 in FIG. 6.
Figure 8:
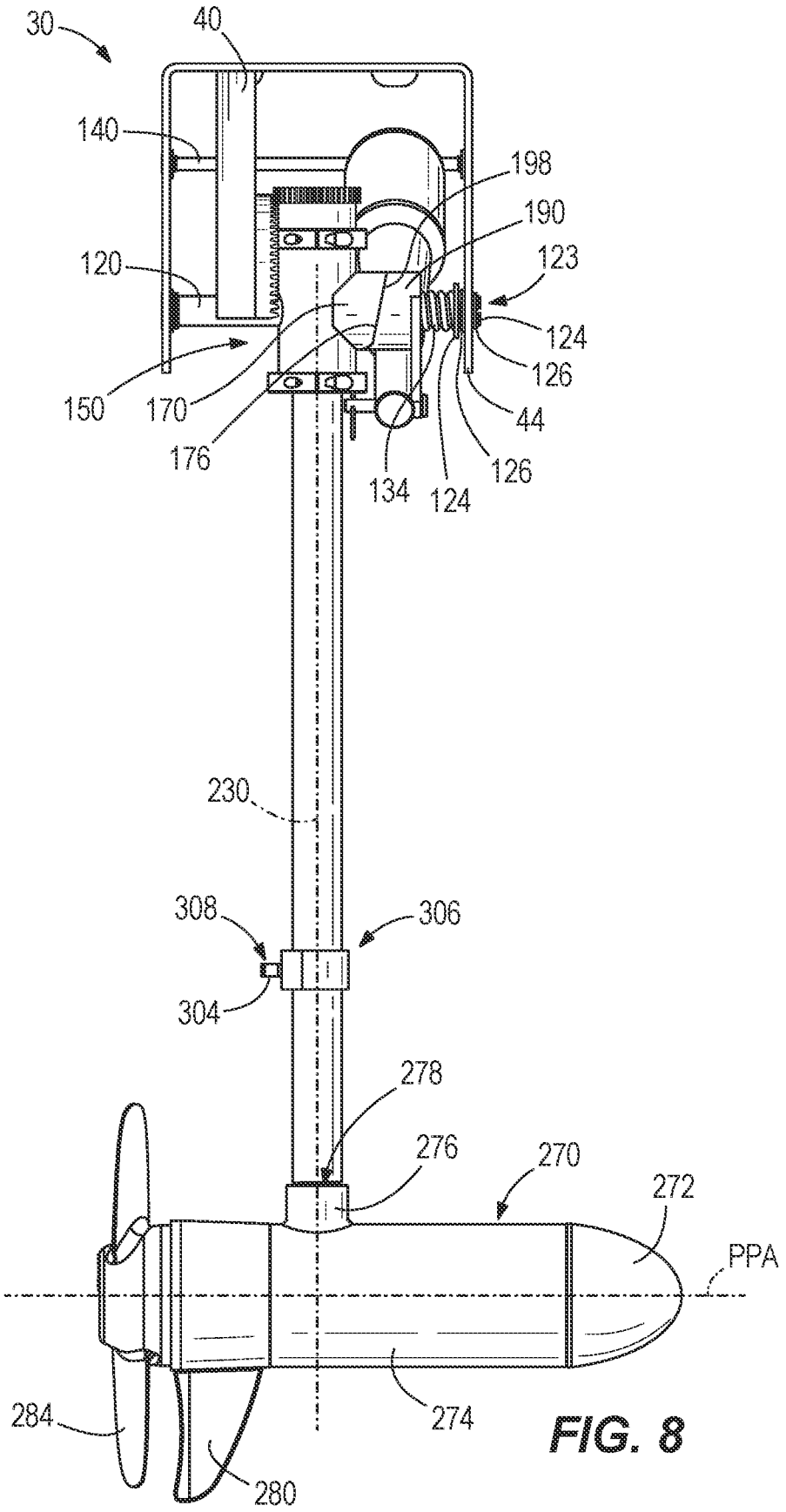
FIG. 8 is a rear view of the system of FIG. 6 in the deployed position.

With reference to FIGS. 2 and 5-6, a pivot rotation device 150 is coupled to the shaft 230 near its proximal end 232, below the moving gear 100. The pivot rotation device 150 includes a main body 152 extending between a first end 154 and a second end 156 with an opening 153 defined therebetween. The shaft 230 is received through the opening 153 between the first end 154 and second end 156 of the main body 152 and rotatable therein. In the embodiment shown, a bushing 155 is received within the opening 153 of the main body 152 and the shaft 230 extends through an opening 157 within the bushing 155. The bushing 155 provides for smooth rotation between the shaft 230 and the main body 152. The shaft 230 is retained within the main body 152 via first and second clamp systems 210, 220. The first clamp system 210 includes two clamp segments 212 coupled together by fasteners 216 received within openings and receivers therein, for example threaded openings for receiving the fasteners 216. The clamp segments 212 are configured to clamp around the shaft 230 just above the main body 152, in the present example with a gasket 213 sandwiched therebetween to provide friction. Likewise, clamp segments 222 of the second clamp system 220 are coupled to each other via fasteners 226 to clamp onto the shaft just below the main body 152, which may also include a gasket sandwiched therebetween. In this manner, the shaft 230 is permitted to rotate within the main body 152, but the first and second clamp systems 210, 220 on opposing ends of the main body 152 prevent the shaft 230 from moving axially through the main body 152.

As shown in FIGS. 2-3 and 5, the shaft 230 is pivotable about a transverse axis (shown as pivot axis PA) formed by coaxially-aligned pivot axles 120, 121. The pivot axles 120, 121 are received within pivot axle openings 52 defined within the sides 44 of the base 40, with bushings 122 therebetween to prevent wear. Snap rings 126 are receivable within grooves defined 128 within the pivot axles 120, 121 to retain the axial position of the pivot axles 120, 121 within the base 40. The interior ends of the pivot axles 120, 121 are received within the main body 152 of the pivot rotation device 150 coupled to the shaft 230. The pivot axle 120 is received within a pivot axle opening 162 of the main body 152 such that the outer surface of the pivot axle 120 engages an interior wall 159 of the main body 152. In the present embodiment, a gap 164 remains at the end of the pivot axle 120 to allow for tolerancing and bending and/or movement of the sides 44 of the base 40, for example.

The pivot rotation device 150 further includes an extension body 170 that extends away from the main body 152. The extension body 170 defines a pivot axle opening 178 therein for receiving the pivot axle 121. As shown in FIG. 5, the pivot axle 121 has an insertion end 129 with threads 127 defined thereon, which engage with threads 173 of the pivot axle opening 178 defined in the extension body 170. A slot 123 is defined in the end of the pivot axle 121 opposite the insertion end 129. The pivot axle 121 is therefore threadably received within the extension body 170 by rotating a tool (e.g., a flathead screwdriver) engaged within the slot 123 defined in the end of the pivot axle 121. A snap ring 126 may also be incorporated and receivable within grooves 128 defined in the pivot axle 121 to prevent axial translation of the pivot axle 121 relative to the sides 44 of the base 40.

As shown in FIGS. 2, 4, and 6, a face 176 of the extension body 170 defines a notch 177 recessed therein, which as will become apparent provides for non-rotational engagement with a pivot arm 190. The pivot arm 190 includes a barrel portion 192 having a face 198 with a protrusion 179 extending perpendicularly away from the face 198. The protrusion 179 is received within the notch 177 when the faces 176, 198 abut each other to rotationally fix the pivot arm 190 and the extension body 170. It should be recognized that other configurations for rotationally fixing the pivot arm 190 and extension body 170 are also contemplated by the present disclosure, for example other keyed arrangements or fasteners.

With reference to FIG. 2, the barrel portion 192 of the pivot arm 190 further defines a pivot axle opening 199 therethrough, which enables the pivot axle 121 to extend therethrough. The pivot arm 190 further includes an extension 200 that extends away from the barrel portion 192. The extension 200 extends from a proximal end 202 coupled to the barrel portion 192 to distal end 204, having an inward face opposite an outward face 208. A mounting pin opening 209 is defined through the extension 200 near the distal end 204, which as discussed below is used for coupling the pivot arm 190 to an actuator 240.

As shown in FIGS. 2 and 4, the pivot arm 190 is biased into engagement with the main body 152 of the pivot rotation device 150 via a biasing device, such as a spring 134. In the example shown, the spring 134 is a coil or helical spring that engages the outward face 208 of the extension 200 of the pivot arm 190 at one end and engages a washer 124 abutting a snap ring 126 engaged within a groove of the pivot axle 121 at the opposite end. In this manner, the spring 134 provides for a biasing force engaging the pivot arm 190 and the main body 152 such that the faces 176, 198 thereof remain in contact during rotation of the pivot arm 190, but also provides a safeguard. For example, if the shaft 230 experiences an impact force (e.g., a log strike), the presently disclosed configuration allows the protrusion 179 (shown here to have a rounded shape) to exit the notch 177 against the biasing force of the spring 134 to prevent the force from damaging other components, such as the actuator 240 coupled to the pivot arm 190 (discussed further below).

Referring to FIGS. 2-4, the stowable propulsion system 30 further includes an actuator 240 (presently shown is a linear actuator), which for example may be an electric, pneumatic, and/or hydraulic actuator presently known in the art. The actuator 240 extends between a first end 242 and second end 244 and has a stationary portion 246 and an extending member 260 that extends from the stationary portion 246 in a manner known in the art. The stationary portion 246 includes a mounting bracket 248 that is coupled to the base 40 via fasteners 252, such as bolts, for example. At the opposite end of the actuator 240, a mounting pin opening 261 extends through the extending member 260, which is configured to receive a mounting pin 262 therethrough to couple the extending member 260 to the pivot arm 190 of the pivot rotation device 150. The mounting pin 262 shown extends between a head 264 and an insertion end 266, which in the present example has a locking pin opening 268 therein for receiving a locking pin 269. The locking pin 269, for example a cotter pin, is inserted or withdrawn to removably retain the mounting pin 262 in engagement between the actuator 240 and the pivot arm 190. In the embodiment of FIGS. 2-4, it should be recognized that actuation of the actuator 240 thus causes pivoting of the shaft 230 about the pivot axis PA.

The stowable propulsion system 30 further includes a propulsion device 270 coupled to the distal end 234 of the shaft 230. The propulsion device 270 may be of a type known in the art, such as an electric device operable by battery. In the example shown, the propulsion device 270 includes a nose cone 272 extending from a main body 274. The main body 274 includes an extension collar 276 that defines a shaft opening 278, whereby the shaft 230 is received within the shaft opening 278 for coupling the shaft 230 to the propulsion device 270. The propulsion device 270 includes a motor 282 therein, whereby control and electrical power may be provided to the motor 282 by virtue of a wire harness 290 extending through the shaft 230, in the present example via the opening 108 defined through the moving gear 100; however, it should be recognized that the wire harness 290 may enter the shaft 230 or propulsion device 270 in other locations. In some configurations, the wire harness 290 also extends through a gasket 291 that prevents ingress of water or other materials into the shaft 230, for example (see FIG. 9). The propulsion device 270 further includes a fin 280 and is configured to rotate the propeller 284 about a propeller axis PPA. The propulsion device 270 extends a length 286 and provides propulsive forces in a direction of propulsion DOP. With reference to FIG. 4, the propulsion device 270 has a width PW that is perpendicular to the length 286, in certain embodiments the width PW being less than the width 64 of the base 40.

As shown in FIG. 6 and discussed further below, the propulsion device 270 is configured to propel the marine vessel 1 through the water in the port-starboard direction PS when the shaft 230 is positioned in the deployed position. It should be recognized that, for simplicity, the propulsion device 270 is described as generating propulsion in the port-starboard direction, and thus that the marine vessel moves in the port-starboard direction. However in certain configurations, the propulsion device 270 may accomplish this movement of the marine vessel in the port-starboard direction by concurrently using another propulsion device coupled elsewhere on the marine vessel 1, for example to provide translation rather than rotation of the marine vessel 1.

It should be recognized that when transitioning the shaft 230 and propulsion device 270 from the stowed position of FIG. 3 to the deployed position of FIG. 6, the shaft 230 pivots 90 degrees about the pivot axis PA from being generally horizontal to generally vertical, and the propulsion device 270 rotates 90 degrees about the length axis LA of the shaft 230 from the propeller axis PPA being within the fore-aft plane FAP (FIG. 1) to extending in the port-starboard direction PS. The present inventors invented the presently disclosed stowable propulsion systems 30 wherein pivoting of the shaft 230 about the pivot axis PA automatically correspondingly causes rotation of the shaft 230 about is length axis LA without the need for additional actuators (both being accomplished by the same actuator 240 discussed above). With reference to FIGS. 2-3, this function is accomplished through a gearset 90, which as discussed above is formed by the engagement of the stationary gear 92 and moving gear 100.

As discussed above, the stationary gear 92 is fixed relative to the base 40 and the moving gear 100 rotates in conjunction with the shaft 230 rotating about its length axis LA. In this manner, as the shaft 230 is pivoted about the pivot axis PA via actuation of the actuator 240, the engagement between the mesh face 96 of the stationary gear 92 and the mesh face 104 of the moving gear 100 causes the moving gear 100 to rotate, since the stationary gear 92 is fixed in place. This rotation of the moving gear 100 thus causes rotation of the moving gear 100, which correspondingly rotates the shaft 230 about its length axis LA. Therefore, the shaft 230 is automatically rotated about its length axis LA when the actuator 240 pivots the shaft 230 about the pivot axis PA. It should be recognized that by configuring the mesh faces 96, 104 of the gears accordingly (e.g., numbers and sizes of gear teeth), the gearset 90 may be configured such that pivoting the shaft 230 between the stowed position of FIG. 4 and the deployed position of FIG. 6 corresponds to exactly 90 degrees of rotation for the shaft 230 about its length axis LA, whether or not the shaft 230 is configured to pivot 90 degrees between its stowed and deployed positions. It should be recognized that other pivoting and/or rotational angles are also contemplated by the present disclosure.

The present inventors invented the presently disclosed configurations, which provide for stowable propulsion systems 30 having a minimal width 64 (FIG. 2) when in the stowed position, clearing the way for use of a scissor type lift 20 or other lifting mechanisms for the marine vessel 1, while also positioning the propulsion device for generating thrust in the port-starboard direction PS when in the deployed position.

As shown in FIG. 6, certain embodiments include stop 80 within the base 40 for stopping, centering, and/or securing the shaft 230 in the stowed position. In the embodiment shown, a centering slot 86 is defined within the bottom 84 of the stop 80. This centering slot 86 is configured to receive a tab 308 that extends from a clamp 306 positioned at a midpoint along the shaft 230. When the shaft 230 is pivoted and rotated into its stowed position as shown in FIG. 2, the tab 308 of the clamp 306 is received within the centering slot 86 of the stop 80, whereby the bottom 84 of the stop 80 itself prevents further upward pivoting of the shaft 230, and whereby the centering slot 86 prevents lateral movement of the propulsion device 270 when in the stowed position.

The embodiment of FIG. 6 further depicts a positional sensor 300 configured for detecting whether the stowable propulsion system 30 is in the stowed position. The positional sensor 300 shown includes a stationary portion 302 and a moving portion 304, whereby the stationary portion 302 is a Hall Effect Sensor positioned adjacent to the centering slot 86 of the stop 80, which detects the moving portion 304 integrated within the tab 308. In this manner, the positional sensor 300 detects when the shaft 230 is properly in the stowed position, and when it is not.

It should be recognized that other positional sensors 300 are also known in the art and may be incorporated within the systems presently disclosed. For example, FIG. 3 depicts an embodiment in which the positional sensor 300 is incorporated within the actuator 240, such as a linear encoder, that can be used to infer the position of the shaft 230 via the position of the extending member 260 of the actuator 240 relative to the stationary portion 246. An exemplary positional sensor 300 is Mercury Marine's Position Sensor ASM, part number 8M0168637, for example.

Figure 9:
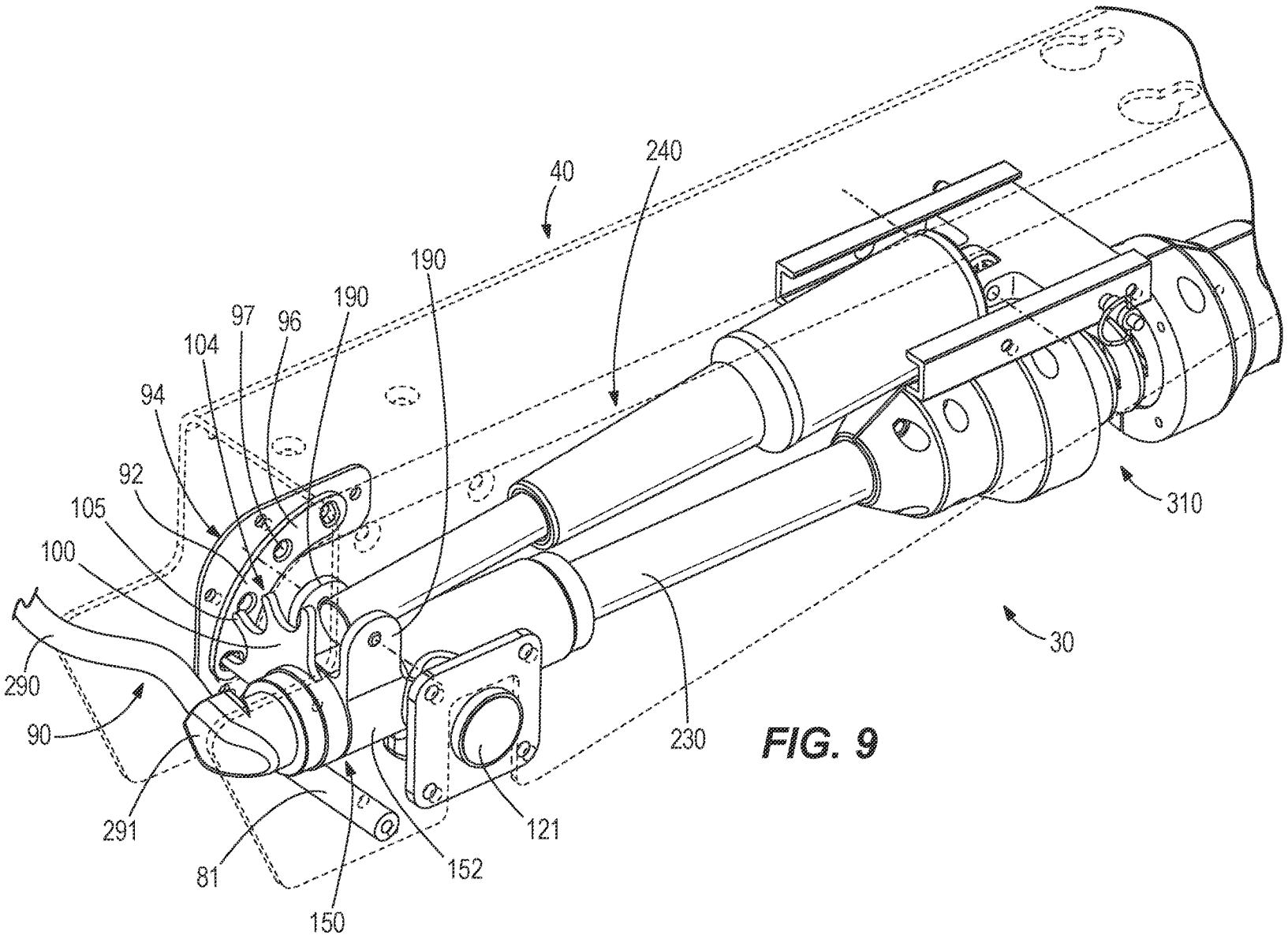
FIG. 9 is an isometric view of an alternate embodiment of system according to the present disclosure.

The present disclosure contemplates other configurations of stowable propulsion systems 30. For example, FIG. 9 depicts an embodiment having two pivot arms 190 coupled directly to the main body 152 of the pivot rotation device 150. The actuator 240 is then pivotally coupled to the two pivot arms 190 in a similar manner as that discussed above. In certain examples, the two pivot arms 190 are integrally formed with the clamp segments 212 of the first clamp system 210, for example. The gearset 90 of the embodiment in FIG. 9 also varies from that discussed above. Specifically, the mesh face 96 of the stationary gear 92 includes openings 97 rather than gear teeth. These openings 97 are configured to receive fingers 105 that extend from the mesh face 104 of the moving gear 100, generally forming a gear and sprocket type system for the gearset 90. The embodiment shown also includes a stop rod 81 for preventing the shaft 230 from rotating too far, or in other words past the deployed position.

Figure 10:
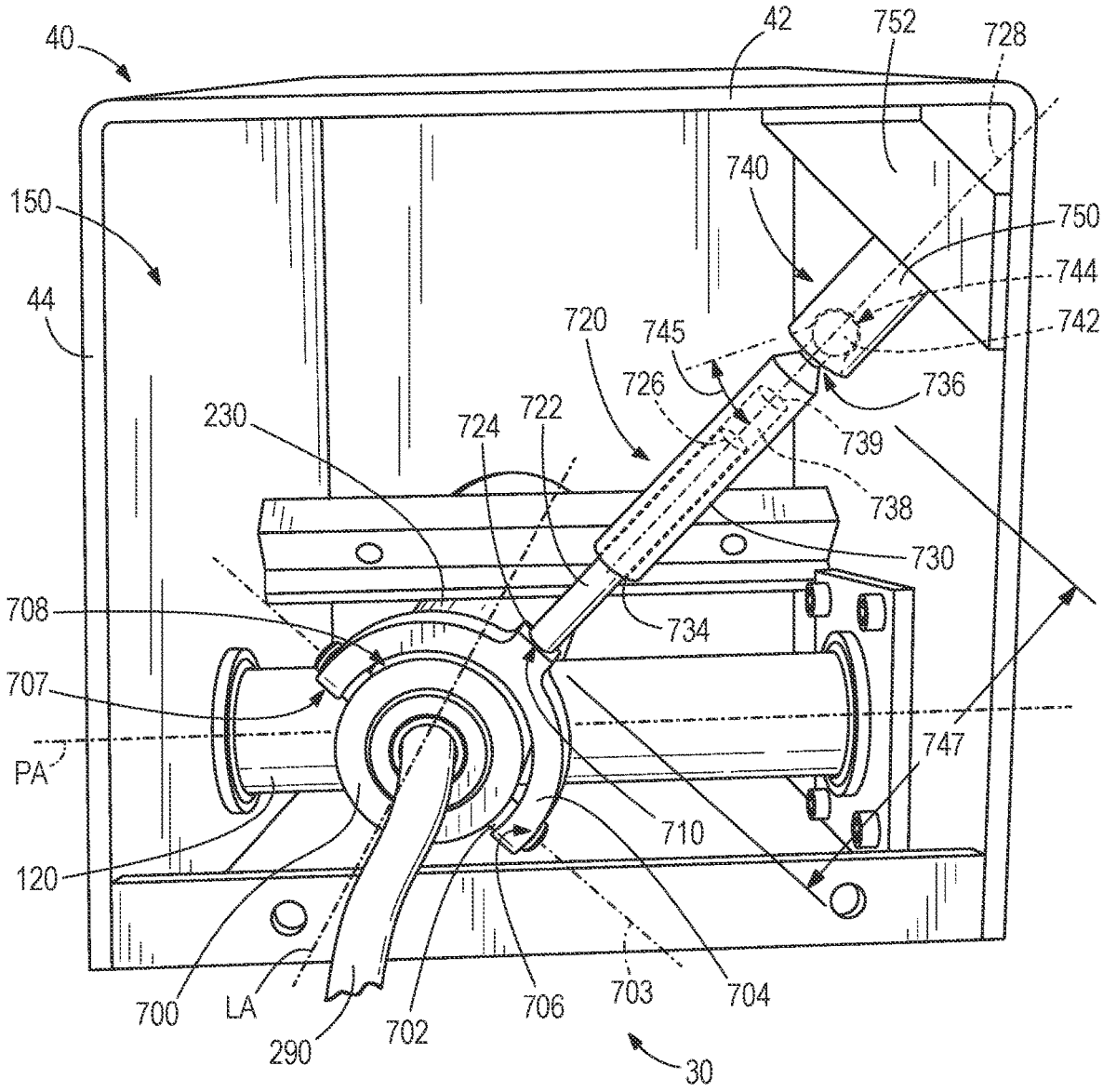
FIG. 10 is an isometric rear view of another exemplary stowable propulsion system according to the present disclosure.

FIG. 10 depicts another alternative embodiment of stowable propulsion system 30 according to the present disclosure. Among other distinctions, this embodiment differs with respect to the pivot rotation device 150. The stowable propulsion system 30 of FIG. 10 includes a slide system 720 that causes rotation of the shaft 230 about the length axis LA in conjunction with this rotation of the pivot axle 120 about the pivot axis PA. The pivot rotation device 150 of FIG. 10 includes a clamp 700 having extensions 702 that extend in opposing directions therefrom. The clamp 700 is secured onto the shaft 230 in a manner previously described or otherwise known in the art. A yoke 704 extends along an arc 708 between opposing ends 707 with a slide connection 710 at a midpoint therebetween. Extension openings 706 are defined near the ends 707 of the yoke 704, which receive the extensions 702 of the clamp 700 therein such that the yoke 704 is pivotable on the extensions 702 about a clamp pivot axis 703 defined by the extensions 702.

A slide system 720 is coupled to the slide connection 710 of the yoke, for example via welding, integral formation, and/or other techniques known in the art, and extends between the yoke 704 and the base 40. The slide system 720 includes a rod 722 extending between a proximal end 724 and distal end 726 defining a slide axis 728 therebetween. The slide system 720 further includes a housing 730 that extends between a proximal end 734 and distal end 736. An opening 738 is defined within the housing 730, extending inwardly from the distal end 736 to a backstop 739. The rod 722 is received within the opening 738 of the housing 730 and permitted to translationally slide therein. The housing 730 is anchored to the base 40, presently shown to be coupled via a arm 750 coupled to the base 40 via a bracket 752 coupled thereto. It will be recognized that the bracket 752, and base 40 may be coupled via fasteners, welding, adhesives, and/or other techniques known in the art.

In the embodiment shown in FIG. 10, the distal end 736 of the housing 730 is coupled to the arm 750 via a ball joint 740. In particular, a ball 742 is coupled to the distal end 736 of the housing 730, which may be integrally formed or coupled thereto using techniques presently known in the art. The ball 742 is received within a socket 744 defined within the arm 750, allowing limited rotation of the housing 730, and thus the slide system 720, relative to the arm 750. In certain examples, the angle 745 is a maximum of 45 degrees on either side of center (other examples being 50 degrees, 30 degrees, or others). It should be recognized that the fully extended and fully compressed lengths 747 of the slide system 720, along with the allowable angles 745, depend upon the mounting locations of the slide system 720 (e.g., the bracket 752, dimensions of the base 40, and specific location of the pivot axle 120 therein) to ensure the intended rotation about the shaft 230 when the pivot axle 120 rotates about the pivot axis PA.

In this manner, the limited rotation of the slide system 720 relative to the arm 750, as well as the limited length 747 of the slide system 720, is particularly configured such that a 90° rotation of the pivot axle 120 about the pivot axis PA causes pivoting of the yoke 704 about the clamp pivot axis 703, and therefore provides equivalent rotation of the shaft 230 about the length axis LA. In certain embodiments, the angle 745 and length 747 of the slide system 720 are configured such that 1° of rotation about the pivot axis PA causes 1° of rotation about the length axis LA. However, other configurations are also anticipated by the present disclosure, including those in which the stowed position is other than 90° different than the deployed position for the stowable propulsion system 30.

More generally, it should be recognized that the slide system 720 provides restricted movement of the yoke 704, and therefore rotation about the length axis LA of the shaft 230 in conjunction with pivoting about the pivot axis PA of the pivot axle 120.

Figure 11:
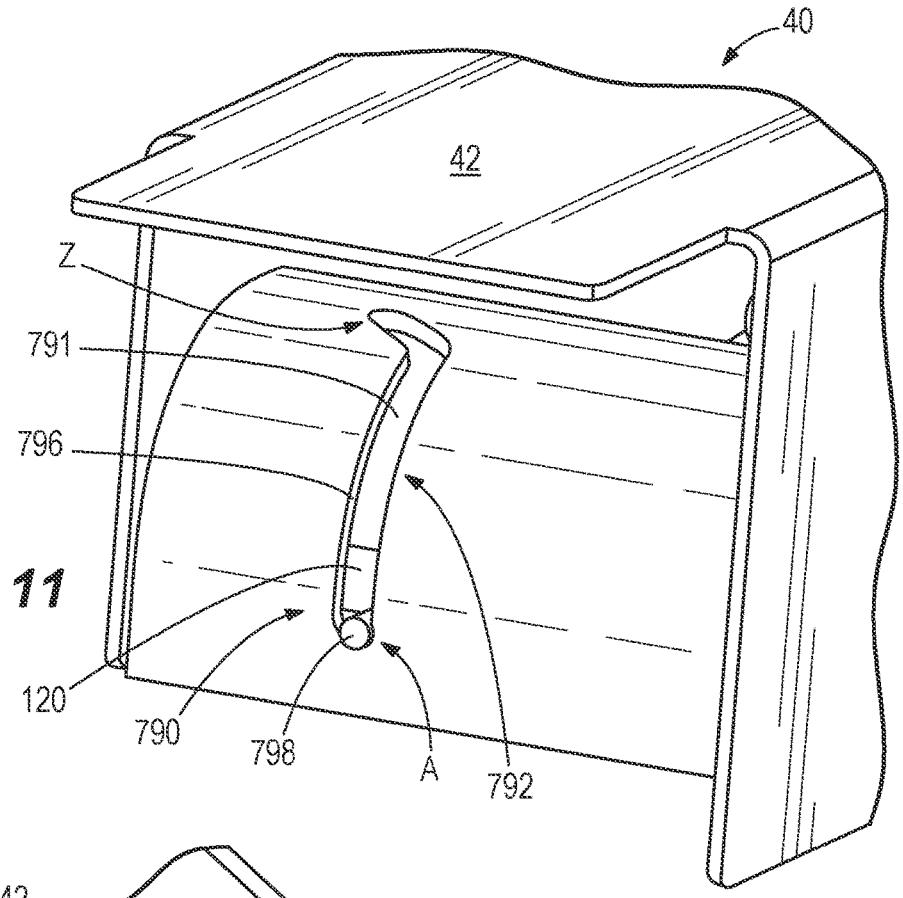
FIG. 11 is an isometric rear view of another exemplary stowable propulsion system according to the present disclosure.
Figure 12:
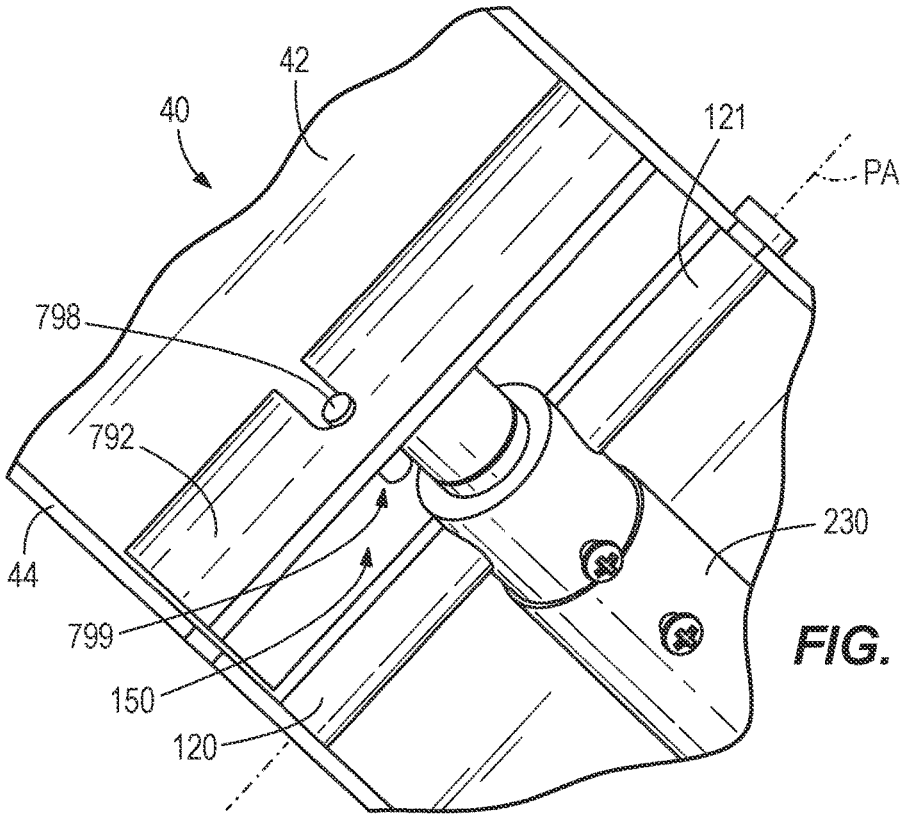
FIG. 12 is an isometric bottom view of the embodiment of FIG. 11.

Another embodiment of stowable propulsion system 30 providing the general functionality of the gearset 90 previously discussed is shown as the slot system 790 of FIGS. 11 and 12. It should be recognized that the term "gearset" is used herein to generally describe all embodiments for transferring a pivoting of the pivot axle 120, 121 to also cause rotation of the shaft 230, including the slot system 790. In this example, the stationary gear 92 previously described is replaced with a curved plate 792 that defines a slot 791 having an edge 796 therein. Likewise, the moving gear 100 previously described is replaced with a pin 800 coupled to the shaft 230. As the shaft 230 is pivoted about the pivot axles 120, 121 (e.g., by an actuator such as discussed above), the pin 800 slides within the slot 791 between a starting point A corresponding to the deployed position, and an ending point Z corresponding to the deployed position. The slot 791 is not linear, but includes an angled portion 793. Due to the angled portion 793 of the slot 791, and the shape of the curved plate 792 (i.e., being generally curved about the pivot axis PA), the pin 800 is caused by engagement with the contoured plate 792 to rotate the shaft 230 coupled to the pin 800 as the pin 800 passes through the angled portion 793 to the end point Z. In the embodiment shown, the pin 800 is coupled to the shaft 230 so that the two extend non-coaxially, but are nonetheless substantially parallel, for example via an extension portion 799 that extends away from the shaft 230. This extension portion 799 creates a moment arm by which the engagement between the curved plate 792 and pin 800 within the slot system 790 causes rotation of the shaft 230 between the stowed and deployed positions. Other configurations for causing this rotation are also anticipated by the present disclosure, specifically without requiring actuation devices beyond those providing the pivoting of the shaft 230.

Figure 13:
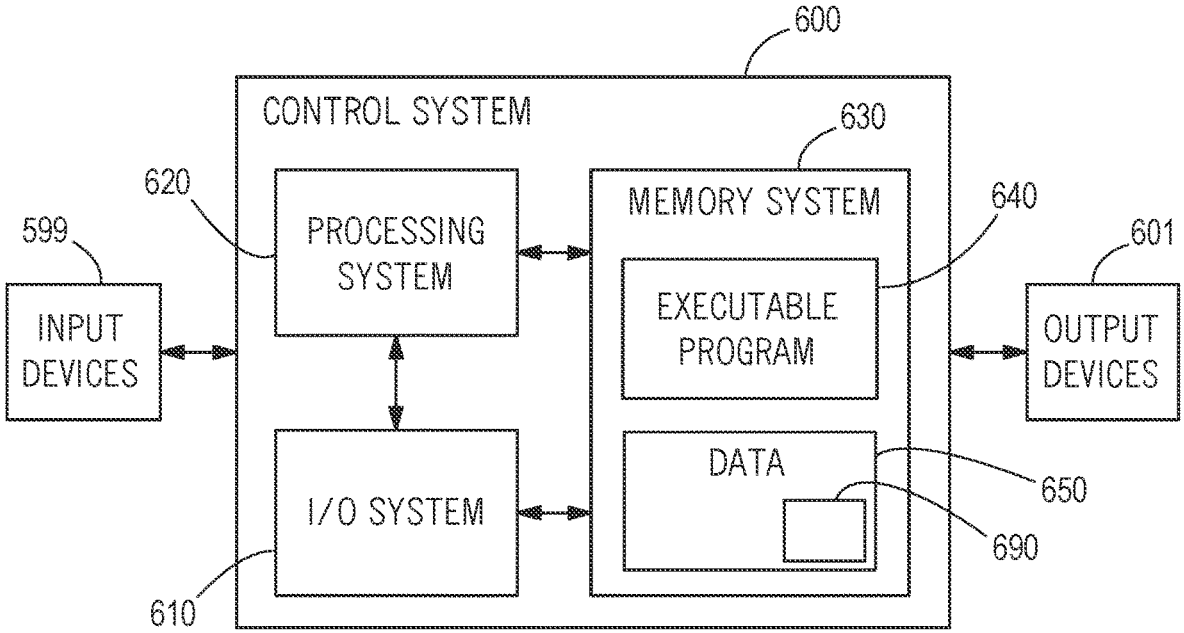
FIG. 13 depicts an exemplary control system for controlling one of the embodiments of stowable propulsion systems according to the present disclosure.

FIG. 13 depicts an exemplary control system 600 for operating controlling the stowable propulsion system 30. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 600 communicates with each of the one or more components of the stowable propulsion system 30 via a communication link CL, which can be any wired or wireless link. The control system 600 is capable of receiving information and/or controlling one or more operational characteristics of the stowable propulsion system 30 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the stowable propulsion system 30. Moreover, the communication link CL lines are meant only to demonstrate that the various control elements are capable of communicating with one another, and do not represent actual wiring connections between the various elements, nor do they represent the only paths of communication between the elements. Additionally, the stowable propulsion system 30 may incorporate various types of communication devices and systems, and thus the illustrated communication links CL may in fact represent various different types of wireless and/or wired data communication systems.

The control system 600 of FIG. 13 may be a computing system that includes a processing system 610, memory system 620, and input/output (I/O) system 630 for communicating with other devices, such as input devices 599 and output devices 601, either of which may also or alternatively be stored in a cloud 602. The processing system 610 loads and executes an executable program 622 from the memory system 620, accesses data 624 stored within the memory system 620, and directs the stowable propulsion system 30 to operate as described in further detail below.

The processing system 610 may be implemented as a single microprocessor or other circuitry, or be distributed across multiple processing devices or sub-systems that cooperate to execute the executable program 622 from the memory system 620. Non-limiting examples of the processing system include general purpose central processing units, application specific processors, and logic devices.

The memory system 620 may comprise any storage media readable by the processing system 610 and capable of storing the executable program 622 and/or data 624. The memory system 620 may be implemented as a single storage device, or be distributed across multiple storage devices or sub-systems that cooperate to store computer readable instructions, data structures, program modules, or other data. The memory system 620 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A stowable propulsion system for a marine vessel, the stowable propulsion system comprising:

a base configured to be coupled to the marine vessel;

a propulsion device configured to propel the marine vessel in water; and a shaft that extends along a length axis and pivotably couples the propulsion device to the base;

wherein the propulsion device is pivotable into and between a stowed position and a deployed position, wherein pivoting the propulsion device causes the shaft to rotate about the length axis, and wherein the shaft is configured such that rotating the shaft causes the propulsion device to pivot.

2. The stowable propulsion system according to claim 1, wherein pivoting the propulsion device towards the deployed position rotates the shaft about the length axis in a first direction and pivoting the propulsion device towards the stowed position rotates the shaft in a second direction that is opposite the first direction.

3. The stowable propulsion system according to claim 1, wherein the shaft pivots about a transverse axis that is perpendicular to the length axis about which the shaft rotates.

4. The stowable propulsion system according to claim 1, wherein the shaft is rotated via a gearset when pivoting.

5. The stowable propulsion system according to claim 1, further comprising an actuator that pivots the shaft into and between the stowed position and the deployed position.

6. A stowable propulsion system for a marine vessel. the stowable propulsion system comprising:

a base configured to be coupled to the marine vessel;

a propulsion device configured to propel the marine vessel in water; and a shaft that extends along a length axis and pivotably couples the propulsion device to the base. wherein the propulsion device is pivotable into and between a stowed position and a deployed position, and wherein pivoting the propulsion device causes the shaft to rotate about the length axis; and an actuator that pivots the shaft into and between the stowed position and the deployed position, wherein the actuator extends and retracts to pivot the shaft into and between the stowed position and the deployed position.

7. The stowable propulsion system according to claim 6, wherein retracting the actuator pivots the shaft towards the deployed position.

8. The stowable propulsion system according the claim 5, wherein the actuator concurrently rotates the shaft about the length axis as the shaft pivots between the stowed position and the deployed position.

9. The stowable propulsion system according the claim 1, wherein the shaft pivots 90 degrees and rotates 90 degrees about the length axis between the stowed position and the deployed position.

10. A marine vessel comprising:

a deck; and a stowable propulsion system suspended from the deck, the stowable propulsion system comprising:

a propulsion device configured to propel the marine vessel in water; and a shaft that extends along a length axis and pivotably couples the propulsion device to the deck;

wherein the propulsion device is pivotable into and between a stowed position and a deployed position, the propulsion device being closer to the deck in the stowed position than in the deployed position, and wherein the propulsor is rotatable about the length axis of the shaft when pivoting into and between the stowed position and the deployed position.

11. The marine vessel according to claim 10, further comprising two or more pontoons coupled to the deck, whereby the two or more pontoons provide floatation for the marine vessel, and whereby the propulsion device is positioned between two of the two or more pontoons when in the stowed position.

12. The marine vessel according to claim 10, wherein pivoting the shaft causes the shaft to rotate.

13. The marine vessel according to claim 10, wherein the stowable propulsion device further comprises an actuator that pivots the propulsion device into and between the stowed position and the deployed position.

14. The marine vessel according to claim 13, wherein the actuator is positioned below the deck.

15. The marine vessel according to claim 13, wherein retracting the actuator pivots the propulsion device towards the deployed position.

16. The marine vessel according to claim 13, wherein the shaft is caused to rotate about the length axis by pivoting the shaft into and between the stowed position and the deployed position.

17. The marine vessel according to claim 10, wherein the shaft pivots 90 degrees and rotates 90 degrees between the stowed position and the deployed position.

18. The marine vessel according to claim 10, wherein the propulsor remains below the deck in the stowed position.

19. The marine vessel according to claim 10, wherein the propulsor is configured to propel the marine vessel in the water in a port-starboard direction when in the deployed position.

20. A stowable propulsion system for a marine vessel, the stowable propulsion system comprising:

a base configured to be coupled to the marine vessel;

a propulsion device configured to propel the marine vessel in water;

a shaft that extends along a length axis and pivotably couples the propulsion device to the base; and an actuator operable to pivot the propulsion device relative to the base and to concurrently rotate the shaft about the length axis while pivoting the propulsion device into and between a stowed position and a deployed position, wherein the shaft is configured such rotating the shaft pivots the shaft.

* * * * *